US007358927B2

(12) United States Patent
Luebke et al.

(10) Patent No.: US 7,358,927 B2
(45) Date of Patent: Apr. 15, 2008

(54) ANTENNA EMPLOYING A COVER

(75) Inventors: Charles J. Luebke, Sussex, WI (US); Matthew F. Planning, Milwaukee, WI (US)

(73) Assignee: Eaton Corporation, Cleveland, OH (US)

( * ) Notice: Subject to any disclaimer, the term of this patent is extended or adjusted under 35 U.S.C. 154(b) by 118 days.

(21) Appl. No.: 10/973,582

(22) Filed: Oct. 26, 2004

(65) Prior Publication Data

US 2006/0097949 A1 May 11, 2006

(51) Int. Cl.
*H01Q 1/00* (2006.01)

(52) U.S. Cl. ..... 343/907

(58) Field of Classification Search ..... 343/907, 343/700 MS, 748, 866, 895; 307/140
See application file for complete search history.

(56) References Cited

U.S. PATENT DOCUMENTS 3,590,271 A * 6/1971 Peters ..... 307/140
4,800,392 A * 1/1989 Garay et al. ..... 343/700 MS
4,988,832 A 1/1991 Shotey
5,278,570 A * 1/1994 Jaramillo et al. ..... 343/702
5,434,579 A * 7/1995 Kagoshima et al. . 343/700 MS
5,736,965 A 4/1998 Mosebrook et al.
5,833,350 A 11/1998 Moreland
5,905,442 A 5/1999 Mosebrook et al.
5,982,103 A 11/1999 Mosebrook et al.
6,000,807 A 12/1999 Moreland
6,183,101 B1 * 2/2001 Chien ..... 362/84
6,442,106 B1 8/2002 Newby et al.
6,444,906 B1 9/2002 Lewis
6,559,807 B2 5/2003 Koslover
6,578,980 B1 * 6/2003 Chen et al. ..... 362/95
6,593,900 B1 7/2003 Craven et al.
6,970,097 B2 * 11/2005 Welles et al. ..... 340/825.49
7,080,787 B2 * 7/2006 Wulff et al. ..... 235/462.45
2001/0015283 A1 8/2001 Sexton
2002/0011963 A1 1/2002 Koslover
2002/0024332 A1 2/2002 Gardner
2004/0021993 A1 2/2004 Lambin et al.

OTHER PUBLICATIONS

Emulation Technology, Inc., "Ultra-Mini Pogo Pin" , http://www.emulation.com/pogo/, Oct. 20, 2004, 3 pp.
Gigaant, "Snap-in Antenna concept", http://www.gigaant.com, 2002,2 pp.

* cited by examiner

*Primary Examiner*—Huedung Mancuso
(74) *Attorney, Agent, or Firm*—Martin J. Moran

(57) ABSTRACT

An antenna is for a wireless communication device mounted in an opening of a wall. The antenna includes a switch cover plate adapted to cover the opening of the wall. The switch cover plate includes a first or front surface adapted to be disposed away from the opening and an opposite second or rear surface adapted to face the opening. An antenna element, such as a dipole or loop, engages the front surface of the cover plate or is disposed between the front and rear surfaces. A connector is electrically interconnected with the antenna element.

27 Claims, 10 Drawing Sheets

ANTENNA EMPLOYING A COVER

BACKGROUND OF THE INVENTION

1. Field of the Invention

This invention pertains generally to antennas and, more particularly, to antennas including a cover.

2. Background Information

It is known to employ covers for electrical outlets, receptacles, wall plates, switches, dimmers, dimmer switches, timers and sockets. Such covers provide a suitable fit onto, for example, a conventional receptacle box or wall box within, for example, the surface of a wall.

It is further known that a receptacle box may include a suitable electrical distribution device (e.g., an electrical outlet or receptacle; an electrical switch, such as a light switch; a dimmer; a dimmer switch; a timer) or other electrical device.

It is also known to employ an antenna on a printed circuit board that is within a lighting control device that, in turn, is within an electrical wall box. See, for example, U.S. Pat. Nos. 5,736,965; 5,905,442; and 5,982,103.

There is room for improvement in covers and antennas.

SUMMARY OF THE INVENTION

These needs and others are met by the present invention, which provides an antenna including a cover adapted to cover an opening of a surface, an antenna element engaging a surface of the cover or disposed between opposing surfaces of the cover, and a connector electrically interconnected with the antenna element.

In accordance with one aspect of the invention, an antenna for a wireless communication device mounted in an opening of a surface comprises: a cover adapted to cover the opening of the surface, the cover including a first surface adapted to be disposed away from the opening and an opposite second surface adapted to face the opening; an antenna element engaging the second surface of the cover or disposed between the first and second surfaces of the cover; and a connector electrically interconnected with the antenna element.

The antenna element may be a dipole antenna including a first linear member engaging the second surface of the cover and a second linear member engaging the second surface of the cover, the first and second linear members being at least substantially co-linear with respect to each other. The connector may include a first terminal electrically connected to the first linear member and a second terminal electrically connected to the second linear member.

The first and second linear members may be disposed between the first and second surfaces of the cover.

The antenna element may be a planar, inverted-F antenna including a first plane and a second plane, the first and second planes being electrically connected and mechanically coupled. The connector may include a first conductor electrically connected to the first plane and a second conductor electrically connected to the second plane.

The antenna element may be a loop antenna including a loop element engaging the second surface of the cover, the loop element including a first end and a second end. The connector may include a first terminal electrically connected to the first end of the loop element and a second terminal electrically connected to the second end of the loop element.

The loop element may be disposed between the first and second surfaces of the cover.

The antenna element may be a patch antenna including a patch member engaging the second surface of the cover.

The patch member may be disposed between the first and second surfaces of the cover.

The antenna element may be plated on the second surface of a plastic cover.

The antenna element may include at least one conductor molded between the first and second surfaces of the plastic cover and at least one terminal protruding through the second surface of the plastic cover and electrically connected to the connector.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein the term "antenna" shall expressly include, but not be limited by, any structure adapted to radiate and/or to receive electromagnetic waves, such as, for example, radio frequency signals.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

Figure 1:
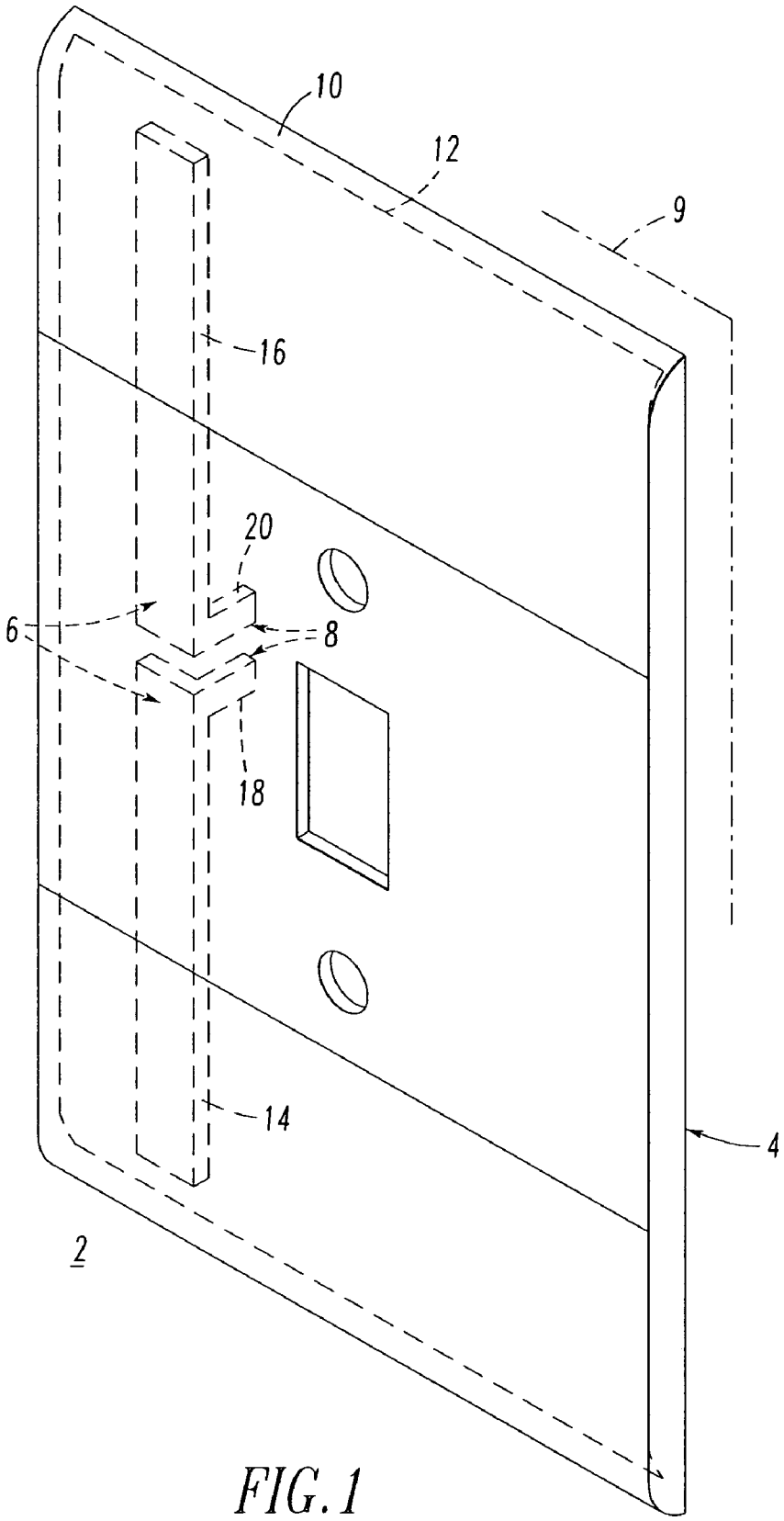
FIG. 1 is an isometric view of an antenna including a cover plate having a dipole antenna element and a conductive connection member in accordance with the present invention.

Referring to FIG. 1, an antenna 2 includes a cover, such as a switch cover plate 4 having a dipole antenna element 6 (shown in hidden line drawing), and a connector, such as a conductive connection member 8 (shown in hidden line drawing). The antenna 2 is adapted for a wireless communication device (not shown) mounted in an opening 9 (shown in phantom line drawing) of a surface, such as a wall (not shown). The cover plate 4, which is adapted to cover the wall opening 9, includes a first or outer (with respect to FIG. 1) surface 10 adapted to be disposed away from the wall opening 9 and an opposite second or inner (with respect to FIG. 1) surface 12 (shown in hidden line drawing) adapted to face the wall opening. The dipole antenna element 6 engages the second surface 12 or is disposed between the first and second surfaces 10,12 (as is shown with the antenna 2' of FIG. 3). The connection member 8 is electrically interconnected with the dipole antenna element 6.

For the dipole antenna element 6, the example two-conductor connection member 8 is preferably employed to provide a suitable balanced feed. Although the switch cover plate 4 is shown, the invention is applicable to a wide range of covers.

Figure 2:
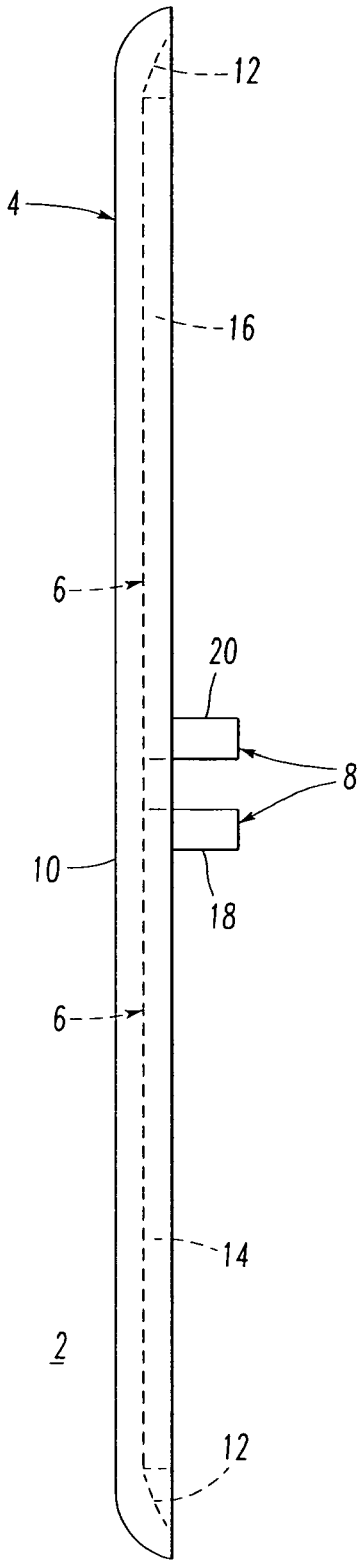
FIG. 2 is a side elevation view of the antenna of FIG. 1 in which the dipole antenna element is disposed on the rear surface of the cover plate.

As shown in FIG. 2, the dipole antenna element 6 is disposed on the inner or rear (toward the bottom of FIG. 2) surface 12 of the cover plate 4. The dipole antenna element 6 includes a first linear member 14 engaging the rear surface 12 and a second linear member 16 engaging the surface 12. The first and second linear members 14,16 are at least substantially co-linear with respect to each other. The connection member 8 includes a first terminal 18 electrically connected to the first linear member 14 and a second terminal 20 electrically connected to the second linear member 16.

EXAMPLE 1

The cover plate 4 may be made of plastic and the dipole antenna element 6 may be plated on the rear surface 12 of the plastic cover plate 4 by a suitable plating-on-plastic method.

Figure 3:
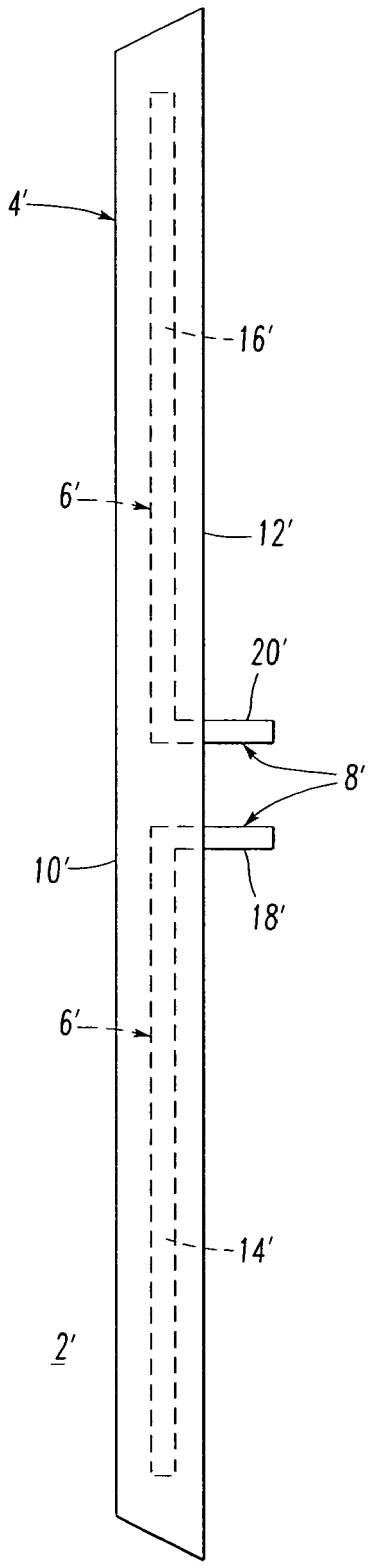
FIG. 3 is a side elevation view of an antenna in accordance with another embodiment of the invention in which a dipole antenna element is disposed between front and rear surfaces of a cover plate.

FIG. 3 shows another antenna 2' that is somewhat similar to the antenna 2 of FIGS. 1 and 2, except that a dipole antenna element 6' is disposed between the front surface 10' and the rear surface 12' of a cover plate 4' by a suitable insert-molding method. The dipole antenna element 6' includes a first linear member 14' disposed between the surfaces 10',12' and a second linear member 16' disposed between those surfaces 10',12'. The first and second linear members 14',16' are at least substantially co-linear with respect to each other. A connector 8' includes a first terminal 18' electrically connected to the first linear member 14' and a second terminal 20' electrically connected to the second linear member 16'. For example, the first and second linear members 14',16' are conductors molded between the surfaces 10',12' by a suitable insert-molding method. The terminals 18',20' protrude through the surface 12' and are electrically connected to the respective members 14',16'.

Figure 4:
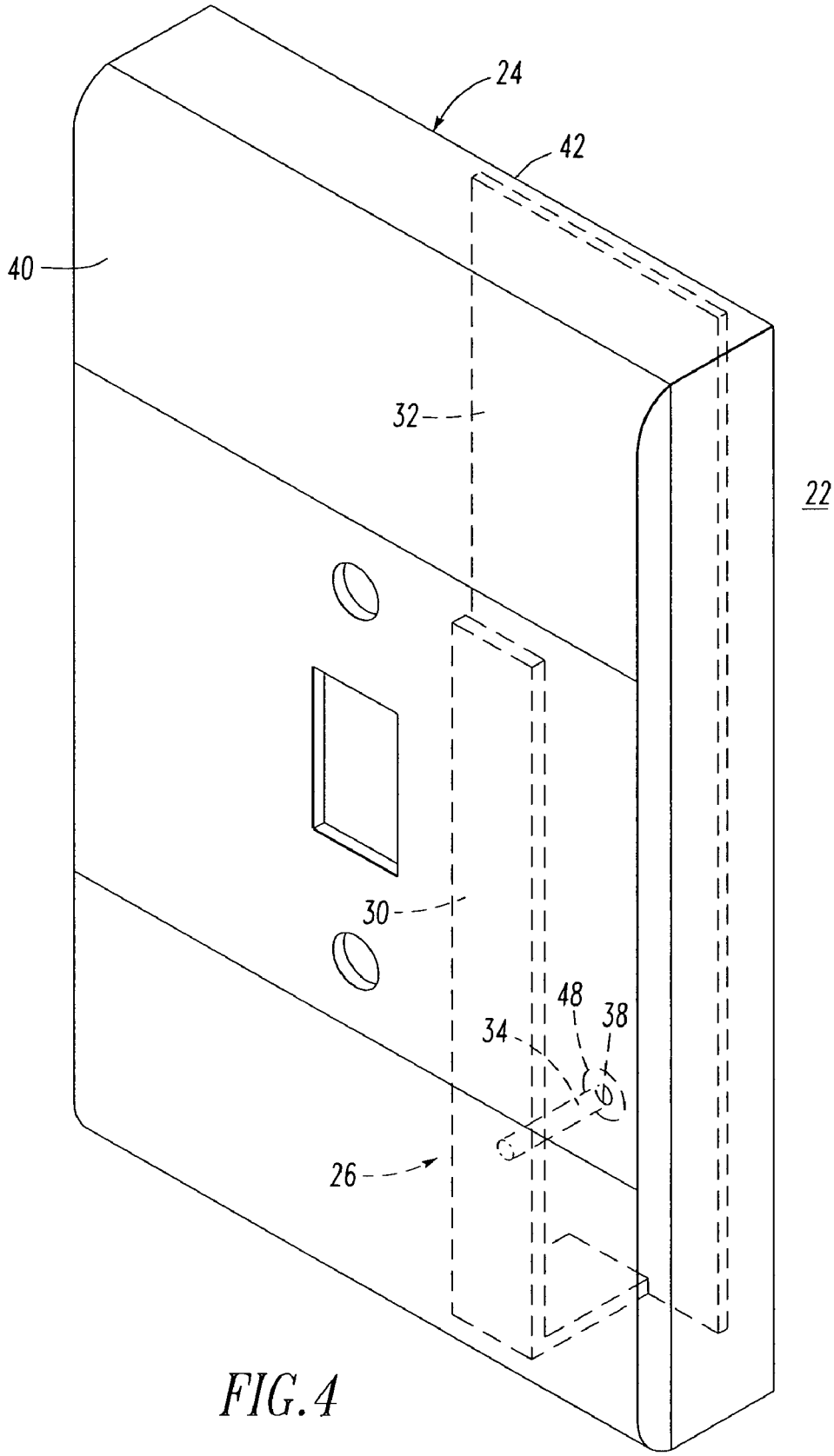
FIG. 4 is an isometric view of an antenna in accordance with another embodiment of the invention including a cover plate, a planar, inverted-F (PIF) antenna element disposed between opposing front and rear surfaces of the cover plate and a conductive connection member in accordance with another embodiment of the invention.
Figure 5:
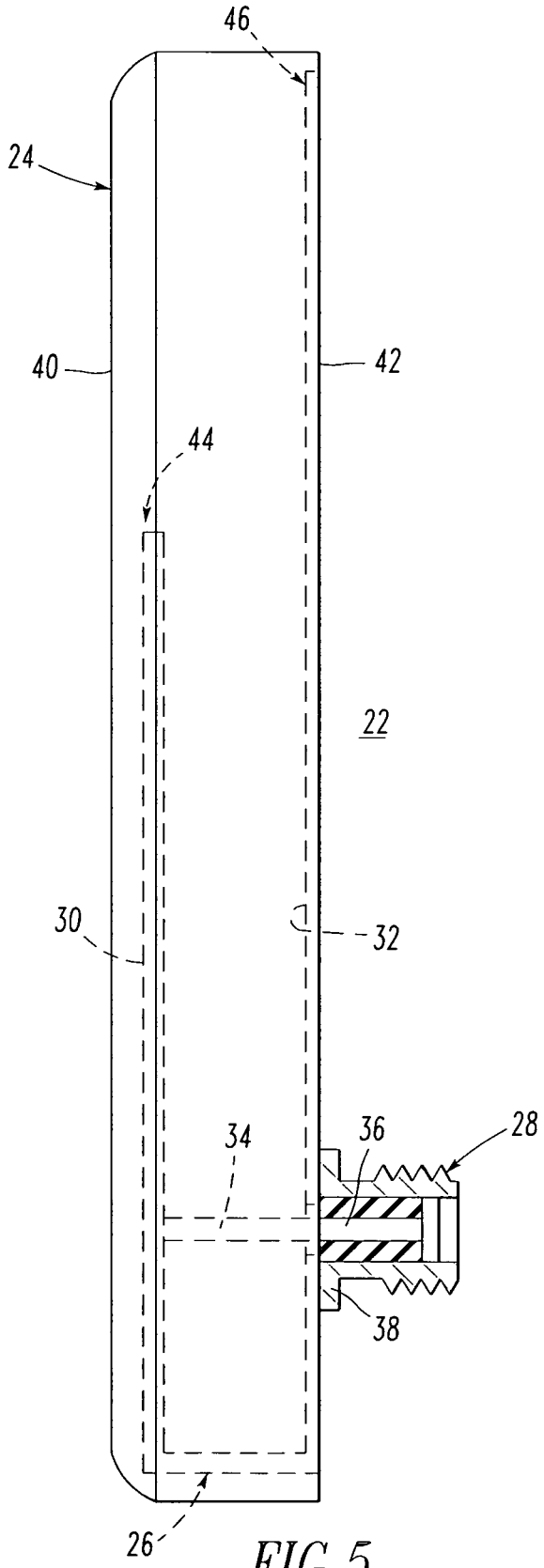
FIG. 5 is a side elevation view of the antenna of FIG. 4.

Referring to FIGS. 4 and 5, another antenna 22 includes a cover plate 24, a planar, inverted-F (PIF) antenna element 26 and a conductive connection member, such as a suitable coaxial connector 28 (FIG. 5). The PIF antenna element 26 is, in general, achieved by short-circuiting a suitable radiating patch or wire 30 to a suitable ground plane 32 with a suitable shorting pin 34. The PIF antenna element 26 can resonate at a relatively much smaller antenna size for a fixed operating frequency. Such PIF designs usually occupy a compact volume. As shown in FIG. 5, conductors 36 and 38 are employed from the shorting pin 34 and the ground plane 32, respectively. For the PIF antenna element 26, the coaxial connector 28 is preferably employed since this is an unbalanced antenna. The cover plate 24 includes a front surface 40 and a rear surface 42, which is engaged by the connector 28. The shorting pin 34 may be part of or an extension of the center conductor 36. The ground plane 32 may be recessed within or form part of the surface 42.

As best shown in FIG. 5, the PIF antenna element 26 includes a first or upper (with respect to FIG. 5) plane 44 and a second or lower (with respect to FIG. 5) plane 46. The planes 44,46 are electrically connected and mechanically coupled. The coaxial connector 28 includes the first or inner or center conductor 36 electrically connected to the first plane 44 by the pin 34 and the second or outer or shield conductor 38 is electrically connected to the second plane 46. The second plane 46 includes an opening 48 (FIG. 4) therein, and the second conductor 38 and/or the pin 34 passes through the opening 48 and is electrically isolated from the second plane 46.

Figure 7:
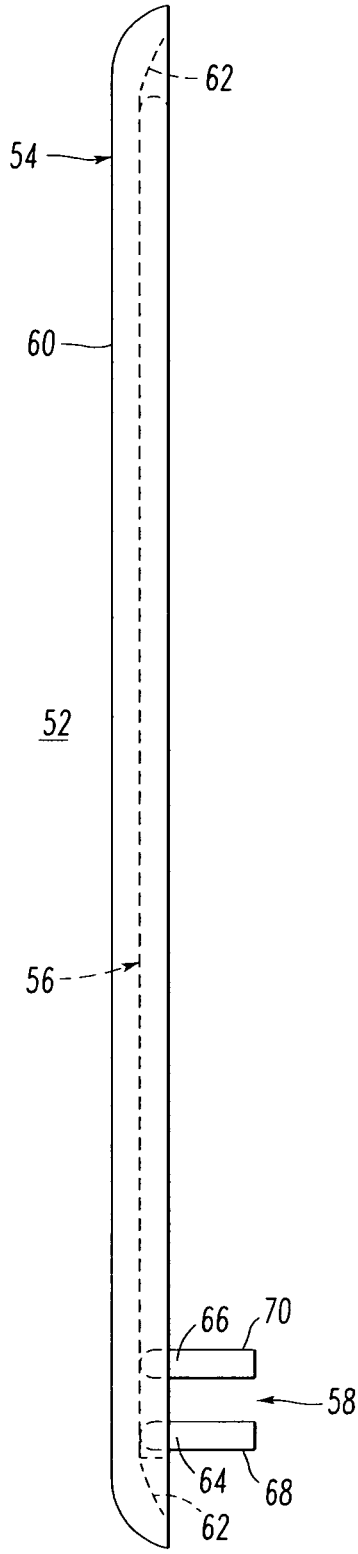
FIG. 7 is a side elevation view of the antenna of FIG. 6 in which the loop antenna element is disposed on the rear surface of the cover plate.
Figure 6:
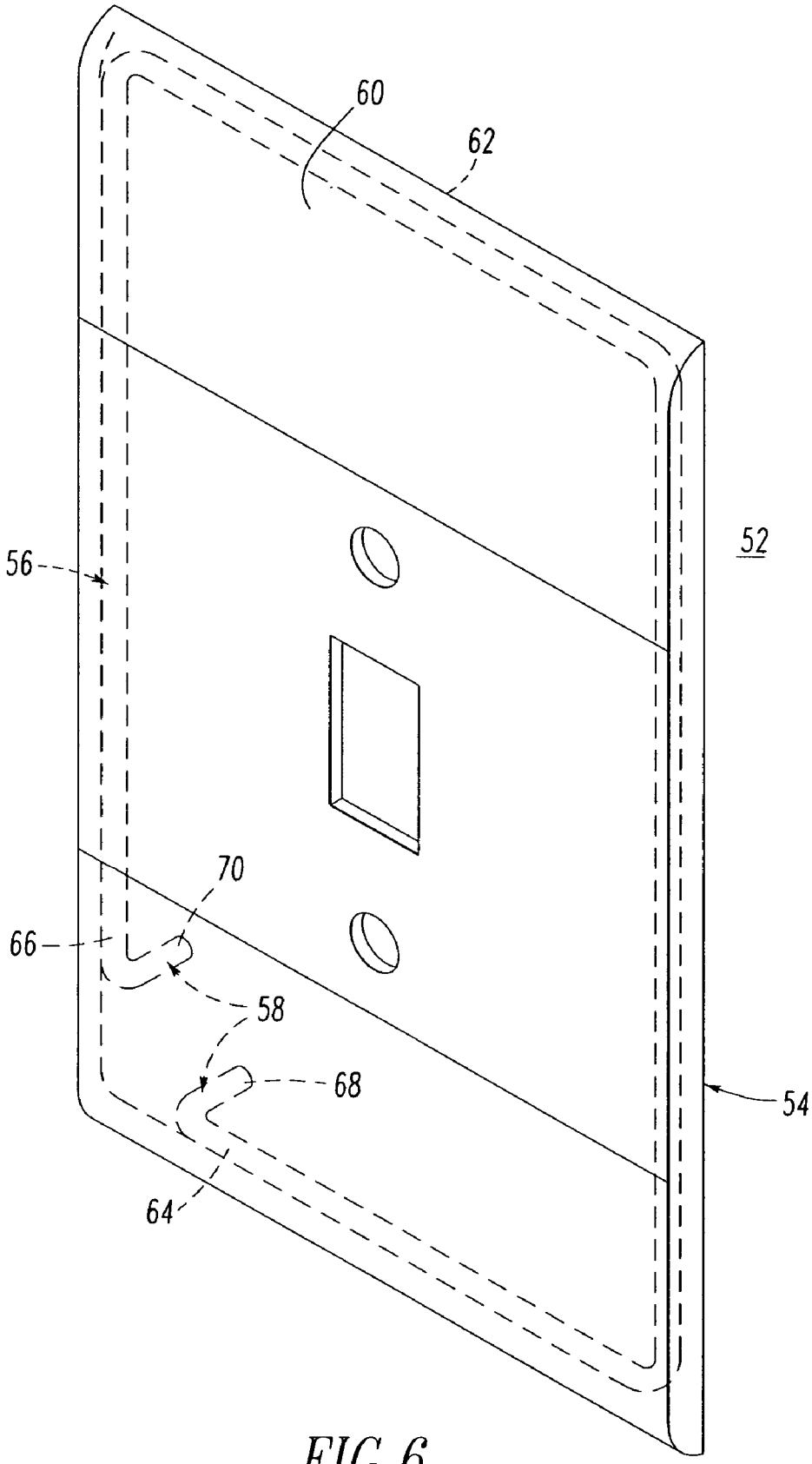
FIG. 6 is an isometric view of an antenna including a cover plate having a loop antenna element and a conductive connection member in accordance with another embodiment of the present invention.

Referring to FIGS. 6 and 7, an antenna 52 includes a cover plate 54, a loop antenna element 56 and a conductive connection member 58. The cover plate 54 includes a front (with respect to FIG. 6) surface 60 and a rear (with respect to FIG. 6) surface 62 (shown in hidden line drawing). As shown in FIG. 7, the loop antenna element 56 is disposed (e.g., by a suitable plating-on-plastic method) on the rear surface 62. The loop antenna element 56 includes a first end 64 and a second end 66. The connection member 58 includes a first terminal 68 electrically connected to the first end 64 and a second terminal 70 electrically connected to the second end 66. For the loop antenna element 56, a suitable two-conductor connection member 58 is preferably employed to provide a suitable balanced feed.

Figure 8:
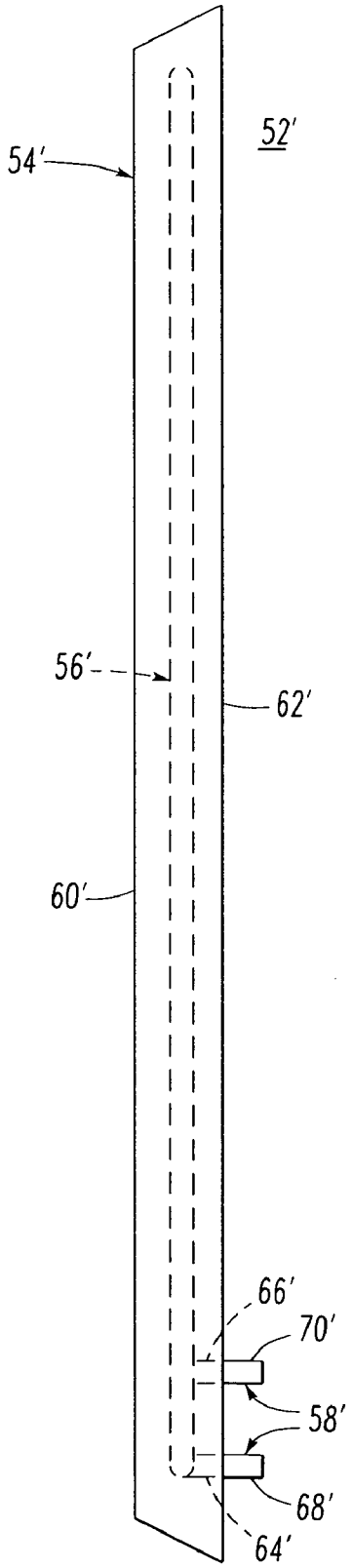
FIG. 8 is a side elevation view of an antenna in accordance with another embodiment of the invention in which a loop antenna element is disposed between front and rear surfaces of a cover plate.

FIG. 8 shows another antenna 52' that is somewhat similar to the antenna 52 of FIGS. 6 and 7, except that a loop antenna element 56' is disposed between the front surface 60' and the rear surface 62' of a cover plate 54' by a suitable insert-molding method. The loop antenna element 56' includes a first end 64' and a second end 66'. The connection member 58' includes a first terminal 68' electrically connected to the first end 64' and a second terminal 70' electrically connected to the second end 66'.

Figure 10:
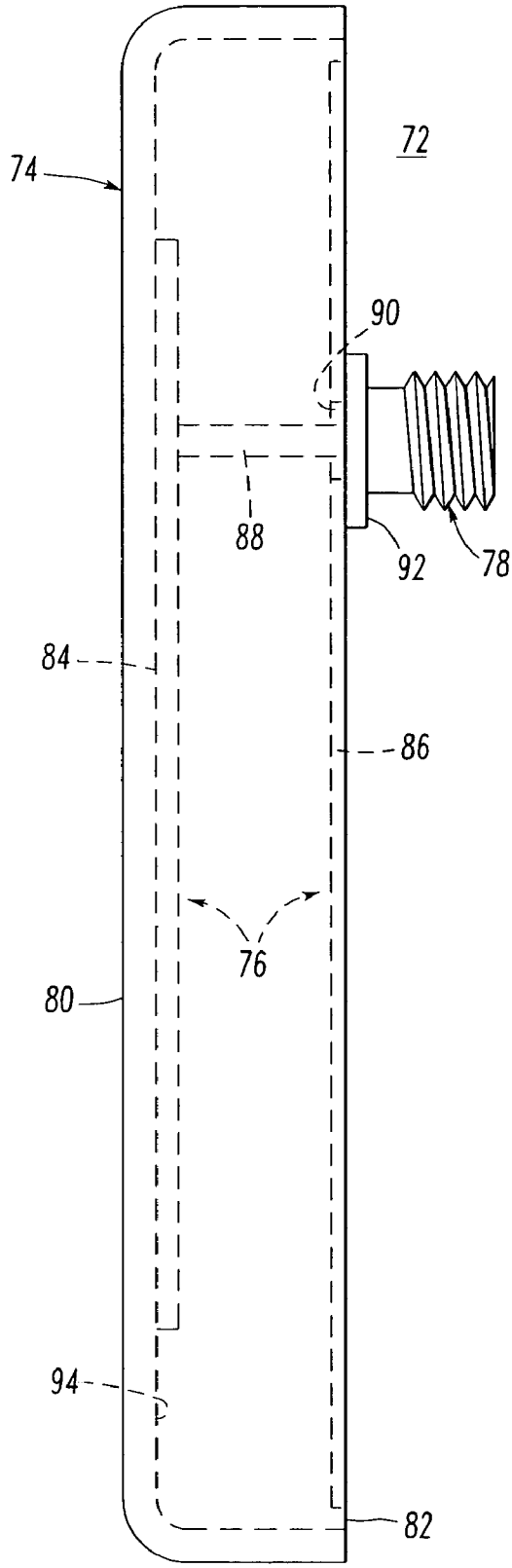
FIG. 10 is a side elevation view of the antenna of FIG. 9 in which the radiating element of the patch antenna element is disposed on the rear surface of the cover plate.
Figure 9:
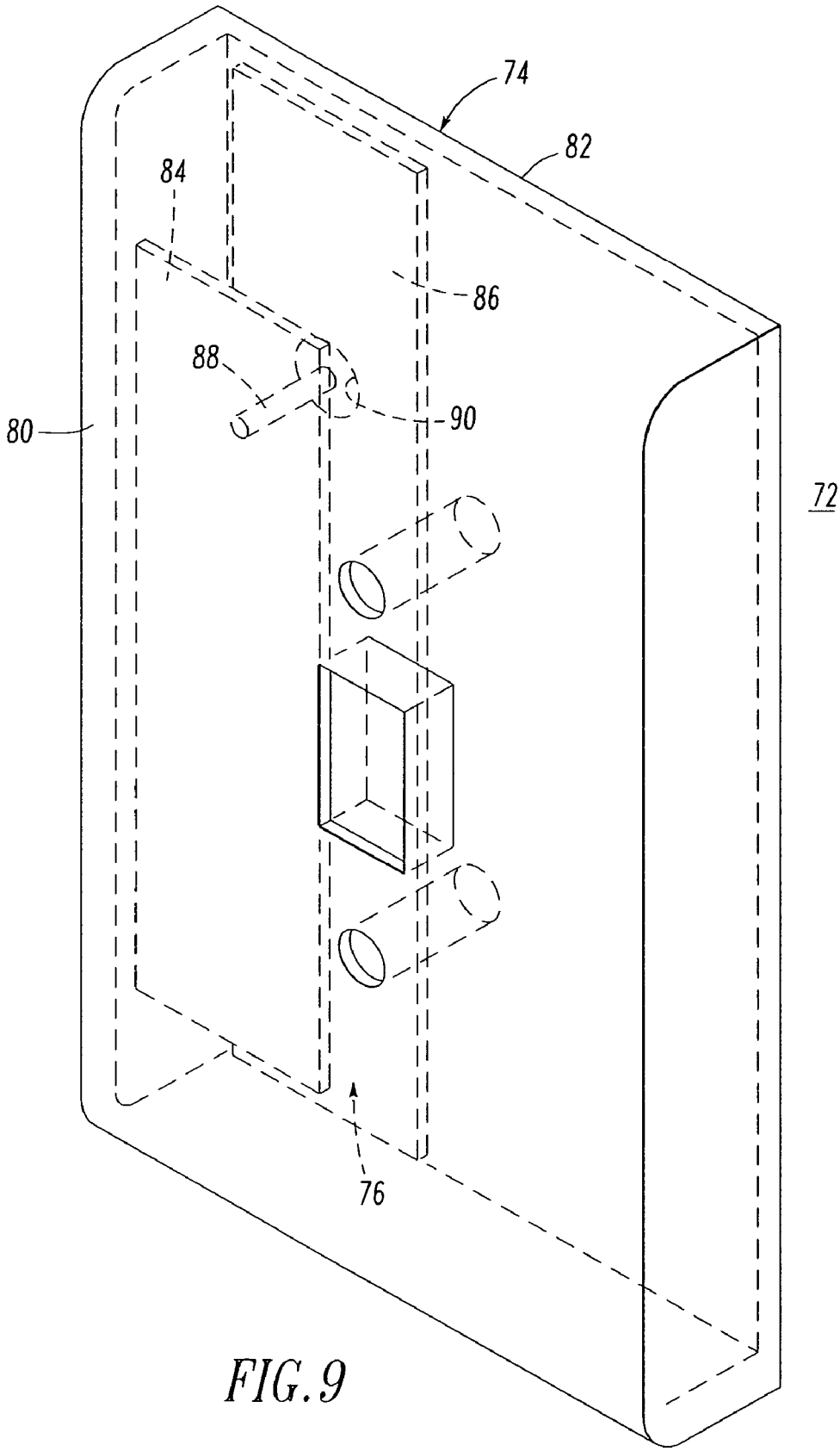
FIG. 9 is an isometric view of an antenna in accordance with another embodiment of the invention including a cover plate, a patch antenna element disposed between opposing front and rear surfaces of the cover plate and a conductive connection member in accordance with another embodiment of the invention.

Referring to FIGS. 9 and 10, an antenna 72 includes a cover plate 74, a patch antenna element 76 and a conductive connection member, such as a suitable coaxial connector 78 (FIG. 10). The patch antenna element 76 is disposed between opposing front and rear surfaces 80 and 82, respectively, of the cover plate 74. The patch antenna element 76 includes a radiating element 84 spaced suitably close to a parallel ground plane 86. The patch antenna element 76 functions as two slot dipoles side by side or as a resonant cavity with open sides that radiate. The radiating element 84 is usually fed at the edge, or a little way in from the edge, as shown in FIG. 9, for example, at lead 88 through opening 90 of the ground plane 86. The lead 88, which may be part of or an extension of the center conductor (not shown) of the coaxial connector 78, protrudes through the rear surface 82. The shield 92 of the coaxial connector 78 is suitably electrically connected to the ground plane 86 and may be mechanically supported by that ground plane 86, as shown, or by the surface 82. The ground plane 86 may be recessed within or form a part of the surface 42.

EXAMPLE 2

One example of the patch antenna element 76 is a consumer-grade GPS antenna. Although a rectangular radiating element or driven element or patch member 84 is shown in FIG. 9, such element may have a circular, square, linear or any other suitable shape (not shown).

EXAMPLE 3

The radiating element 84 of the patch antenna element 76 may be disposed on an internal surface 94 by a suitable plating-on-plastic method.

Figure 11:
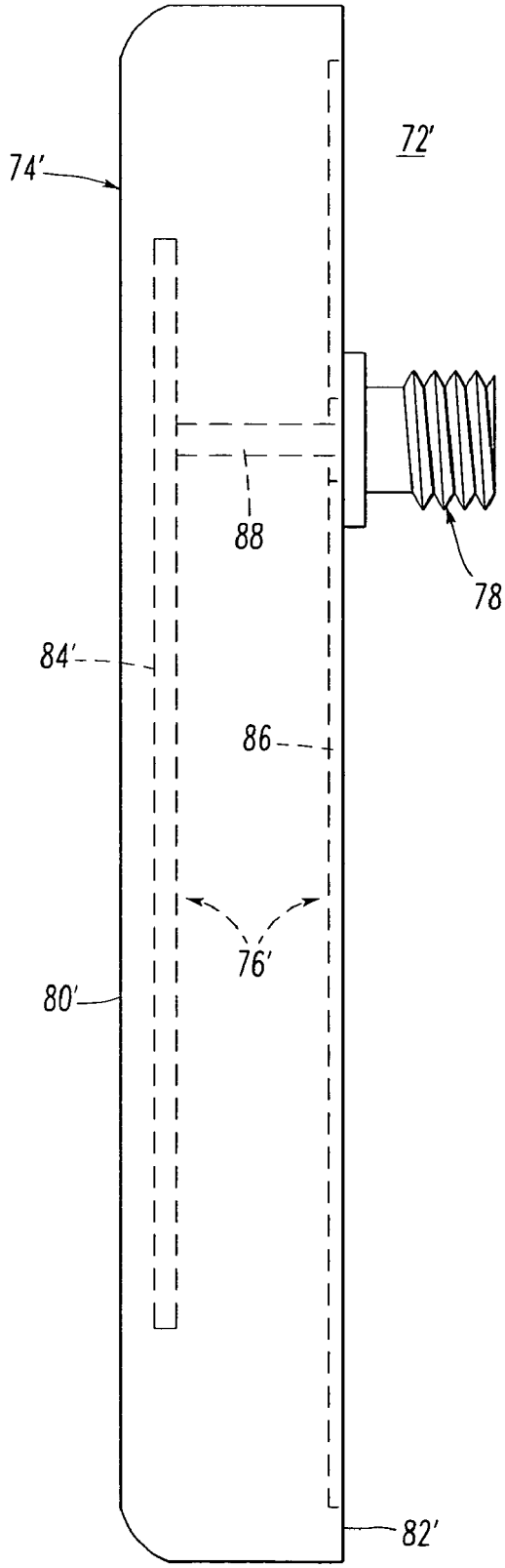
FIG. 11 is a side elevation view of an antenna in accordance with another embodiment of the invention in which a patch antenna element is disposed between front and rear surfaces of a cover plate.

FIG. 11 shows another antenna 72' that is somewhat similar to the antenna 72 of FIGS. 9 and 10, except that a radiating element 84' of a patch antenna element 76' is disposed between the front surface 80' and the rear surface 82' of a cover plate 74' by a suitable insert-molding method.

EXAMPLE 4

The antenna elements 6 (FIG. 1) and 56 (FIG. 7) and the radiating element 84 (FIG. 9) may be formed by a suitable metalized-deposition on the corresponding cover plates 4,54,74 (e.g., without limitation, made of a suitable plastic).

EXAMPLE 5

The antenna elements 6' (FIG. 3) and 56' (FIG. 8) and the radiating element 84' (FIG. 11) may be any suitable conductor (e.g., without limitation, a wire) that is inside the corresponding cover plates 4',54',74' (e.g., without limitation, made of a suitable plastic) at the time of its formation (e.g., without limitation, casting).

EXAMPLE 6

The disclosed plastic cover plates 4,4',24,54,54',74,74', for example, preferably possess material characteristics that are permissive to signal propagation within the radio frequency band of interest.

EXAMPLE 7

Although for purposes of illustration switch cover plates are disclosed, any suitable cover (e.g., without limitation, a receptacle cover; a wall box cover; an outlet cover; a wall plate cover; a switch cover; a dimmer cover; a dimmer switch cover; a timer cover; a socket cover) may be employed that provides, for example, a suitable fit onto, for example, a conventional receptacle or wall box (not shown) within, for example, a surface (e.g., a wall).

EXAMPLE 8

The loop antenna element 56 of FIG. 6 has two conductor outputs 68,70, such as wires or leads, that may be pressed into sprung, clamp type sockets (not shown) on a corresponding printed circuit board (not shown).

EXAMPLE 9

Non-limiting uses for the disclosed antennas 2,2',22,52, 52',72,72' include application in residential (e.g., homes; apartments; mobile homes), industrial or commercial environments; buildings (e.g., walls thereof); and equipment, which employs a cover, such as a cover plate, to control or operate something, to monitor something, to communicate something, to ventilate, heat or cool something, or to illuminate a space.

EXAMPLE 10

As a refinement of Example 9, a suitable wireless communication device (not shown) may be mounted in an opening (e.g., in a receptacle box (not shown)) of a surface, such as a wall, with the disclosed cover plate 4,4',24,54,54', 74,74' covering that opening disposing the corresponding antenna element away from the interior of the opening (e.g., away from the interior of the receptacle box). Hence, the disclosed cover plates are not disposed within the receptacle box (not shown). Therefore, the disclosed antennas 2,2',22, 52,52',72,72' provide relatively better radiation and/or reception, and relatively less attenuation than if they were within such a receptacle box. Furthermore, the disclosed antennas are protected by the disclosed cover plates.

EXAMPLE 11

In an application of the disclosed switch cover plates, the wireless signals to and/or from the disclosed antennas replace, for example, power wires (not shown) that previously fed power to, for example, lighting (not shown).

EXAMPLE 12

Although conventional plastic (e.g., having suitable fire retardant properties; suitable dielectric breakdown strength) for cover plates may be employed, preferably, the relative permittivity ($\in_r$) of the plastic material is suitably close to or equal to 1 (i.e., the permittivity of air).

EXAMPLE 13

Figure 12:
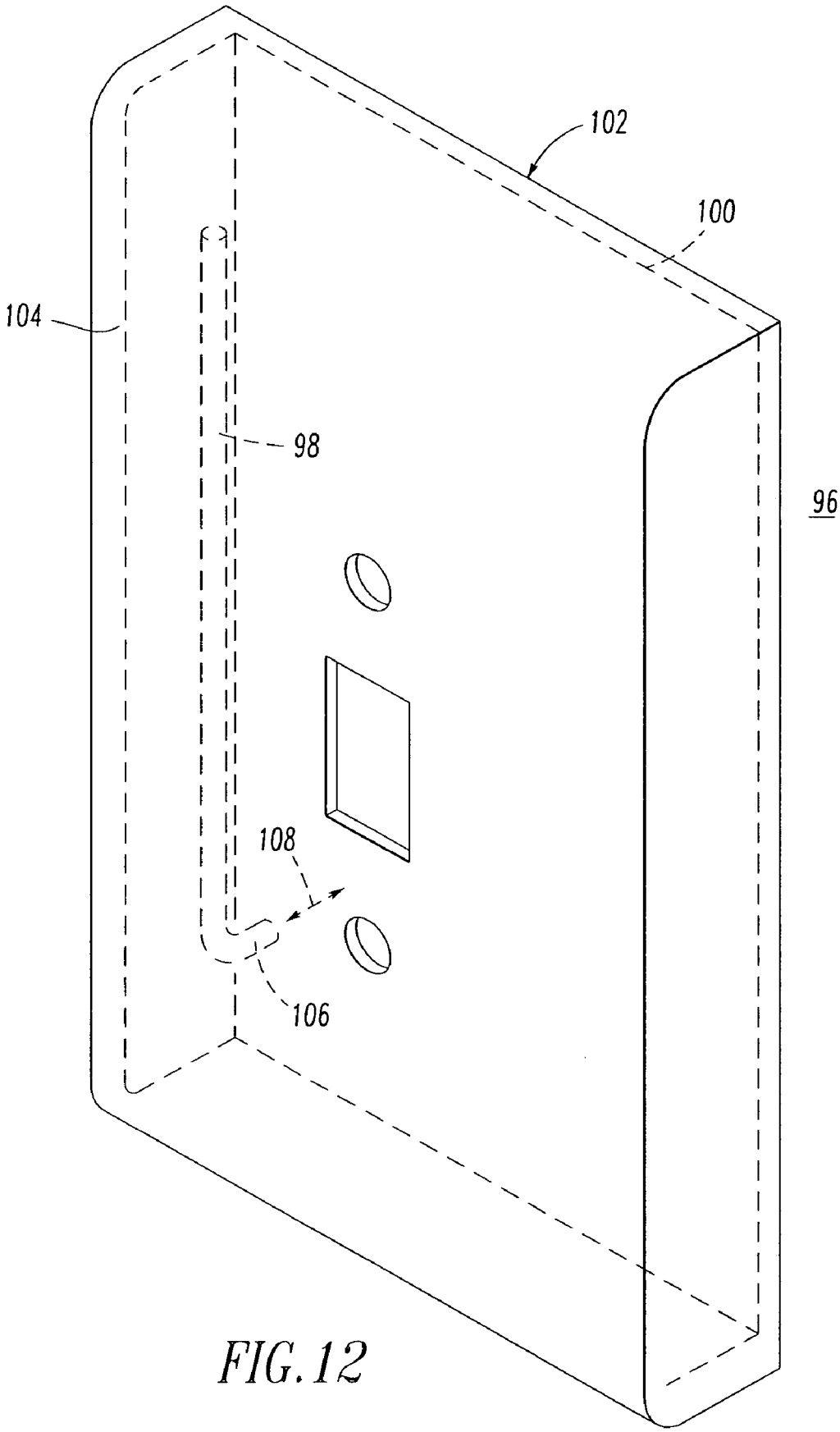
FIG. 12 is an isometric view of an antenna in accordance with another embodiment of the invention including a cover plate having a single-ended high-impedance antenna, such as a quasi-monopole antenna element, and a conductive connection member.

Although two-terminal connectors are disclosed, it will be appreciated that antennas employing a single terminal may be employed. As shown in FIG. 12, a single-ended, high-impedance antenna 96 includes an antenna element 98 engaging the rear surface 100 of the cover 102. Alternatively, the antenna element (not shown) may be disposed (e.g., cast) between the front surface 104 and the rear surface 100 as was shown with the antenna 2' of FIG. 3 or the antenna 52' of FIG. 8. A suitable connector 106 is electrically interconnected with the antenna element 98. The antenna element 98 may be plated-on or may be made of foil suitably disposed on the rear surface 100. An antenna signal 108 may be sent to and/or received from a suitable transmitter and/or receiver module (not shown).

For example, if a coaxial cable (not shown) is employed, then the center conductor (not shown) thereof is electrical connected to the connector 106 and the shield (not shown) thereof is either not terminated or is electrically connected to a suitable ground plane (not shown). The antenna 96 (e.g., a quasi-monopole antenna) functions somewhat similar to a monopole antenna (not shown) that employs a single-wire element (not shown) emanating from a preferably perpendicular ground plane (not shown).

EXAMPLE 14

The cover plates 4 (FIG. 1) or 54 (FIG. 6) or 102 (FIG. 12) may be made of plastic and the dipole antenna element 6 or the loop antenna element 56 or the single-ended, high-impedance antenna element 98 may be attached on the rear surfaces 12 or 62 or 100, respectively, by employing a suitable metal foil antenna structure (not shown) and a suitable adhesive film or backing (not shown).

As set forth in Examples 15-18, below, a wide range of connection devices may be employed for the antennas and connectors disclosed herein.

EXAMPLE 15

Figure 13:
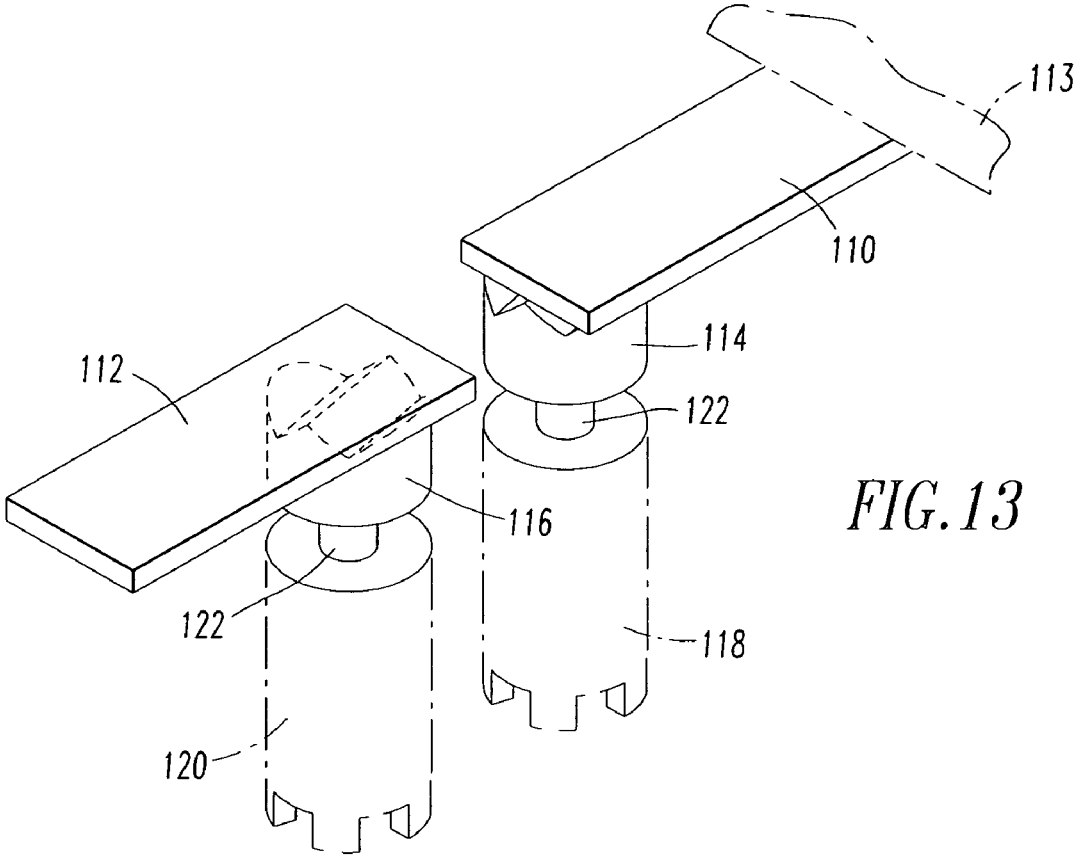
FIGS. 13 and 14 are isometric views of antennas including other connector mechanisms in accordance with other embodiments of the invention.

For an antenna element made of foil, such as the two dipole foil elements 110,112 of FIG. 13 disposed on a cover surface 113, a suitable connector includes two pogo-pin devices 114,116 and two corresponding mating portions 118,120 (shown in phantom line drawing) that accept the sprung contact plungers 122 of the pogo-pin devices 114, 116.

EXAMPLE 16

Although coaxial connectors 28 (FIG. 5) and 78 (FIGS. 10 and 11) are shown, a suitable coaxial "pigtail" (not shown) may be employed whereby the center conductor (not shown) and the shield (not shown) are suitable electrically connected (e.g., without limitation, soldered) to the corresponding antenna connector terminals (not shown).

EXAMPLE 17

Figure 14:
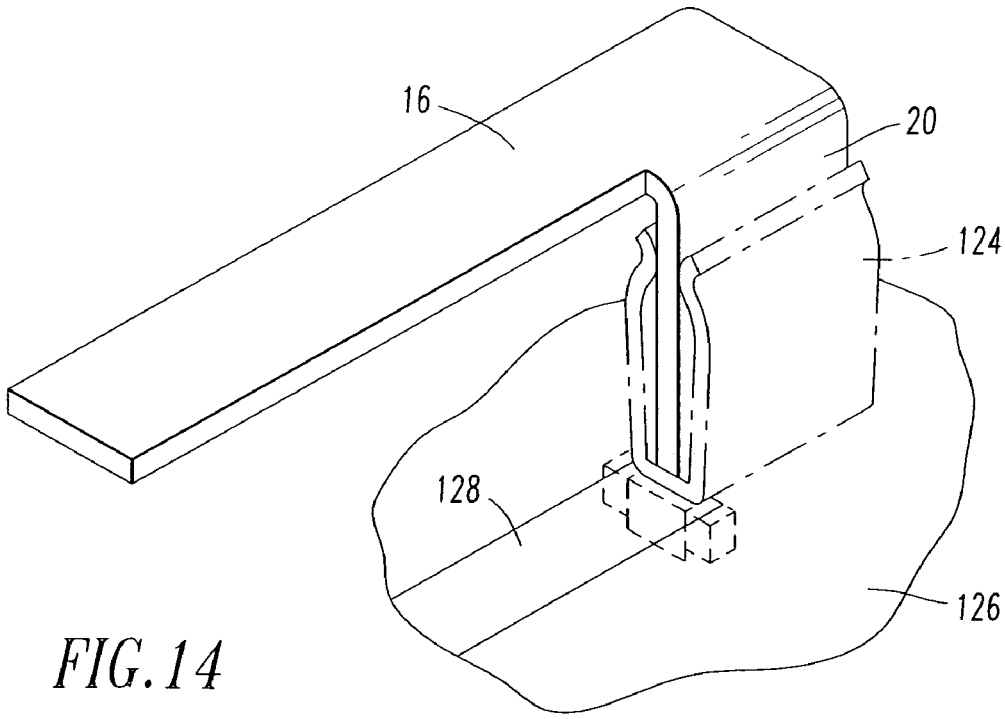

A suitable pin-in-socket or other suitable spring-loaded socket or other suitable spring clip may be employed to accept the corresponding antenna connector terminals, such as 18,20 of FIG. 1. For example, the spring clip 124 (shown in phantom line drawing) of FIG. 14 springs against the corresponding terminal 20 to provide a suitable electrical and mechanical connection to the corresponding transmitter and/or receiver module (not shown) including a printed circuit board 126 (shown in phantom line drawing) and a radio frequency trace 128 (shown in phantom line drawing).

EXAMPLE 18

As an alternative to a spring clip, which requires insertion parallel to the spring in order to displace the spring, a suitable compression contact (not shown) may be created with a suitable clamp type arrangement.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An antenna for a wireless communication device mounted in an opening of a surface, said antenna comprising:

a cover adapted to cover the opening of said surface, said cover including a first surface adapted to be disposed away from said opening and an opposite second surface adapted to face said opening;

an antenna element engaging the second surface of said cover or disposed between the first and second surfaces of said cover; and a connector electrically interconnected with said antenna element, said connector extending away from the second surface of said cover and external to said cover.

2. The antenna of claim 1 wherein said cover is selected from the group consisting of a wall plate cover, a switch cover plate, a switch cover, an outlet cover, a dimmer cover, a dimmer switch cover, a timer cover, and a socket cover.

3. The antenna of claim 1 wherein said antenna element is selected from the group consisting of a dipole antenna; a loop antenna; a planar, inverted-F antenna; a patch antenna; and a single-ended, high-impedance antenna.

4. The antenna of claim 1 wherein said connector is selected from the group consisting of a coaxial connector, and a two-terminal connector.

5. The antenna of claim 1 wherein said antenna element is a dipole antenna.

6. The antenna of claim 5 wherein said dipole antenna includes a first linear member engaging the second surface of said cover and a second linear member engaging the second surface of said cover, said first and second linear members being at least substantially co-linear with respect to each other; and wherein said connector is a first terminal directly electrically connected to said first linear member and a second terminal directly electrically connected to said second linear member.

7. The antenna of claim 1 wherein said antenna element is a planar, inverted-F antenna.

8. The antenna of claim 7 wherein said planar, inverted-F antenna includes a first plane and a second plane, said first and second planes being electrically connected and mechanically coupled; and wherein said connector includes a first conductor directly electrically connected to said first plane and a second conductor directly electrically connected to said second plane.

9. The antenna of claim 7 wherein said second plane includes an opening therein; and wherein said second conductor passes through the opening of said second plane.

10. The antenna of claim 1 wherein said antenna element is a loop antenna.

11. The antenna of claim 10 wherein said loop antenna includes a loop element engaging the second surface of said cover, said loop element including a first end and a second end; and wherein said connector is a first terminal directly electrically connected to the first end of said loop element and a second terminal directly electrically connected to the second end of said loop element.

12. The antenna of claim 1 wherein said antenna element is a patch antenna.

13. The antenna of claim 12 wherein said patch antenna includes a patch member engaging the second surface of said cover.

14. The antenna of claim 1 wherein said cover is made of plastic.

15. The antenna of claim 14 wherein said antenna element is plated on the second surface of said plastic cover.

16. The antenna of claim 14 wherein said connector includes a conductor protruding through the second surface of said plastic cover.

17. The antenna of claim 1 wherein said connector engages the second surface of said cover.

18. The antenna of claim 1 wherein said connector is a one-terminal connector and said antenna element is a single-ended, high-impedance antenna.

19. The antenna of claim 1 wherein said antenna element engages the second surface of said cover.

20. An antenna for a wireless communication device mounted in an opening of a surface, said antenna comprising:

a cover adapted to cover the opening of said surface, said cover including a first surface adapted to be disposed away from said opening and an opposite second surface adapted to face said opening;

an antenna element insert-molded between the first and second surfaces of said cover; and a connector electrically interconnected with said antenna element, wherein said connector extends away from the opposite second surface of said cover and external to said cover.

21. The antenna of claim 20 wherein said cover is made of plastic; and wherein said antenna element includes at least one conductor molded between the first and second surfaces of said plastic cover and at least one terminal protruding through the second surface of said plastic cover and electrically connected to said connector.

22. An antenna for a wireless communication device mounted in an opening of a surface, said antenna comprising:

a cover adapted to cover the opening of said surface, said cover including a first surface adapted to be disposed away from said opening and an opposite second surface adapted to face said opening;

an antenna element engaging the opposite second surface of said cover or disposed between the first and opposite second surfaces of said cover; and a connector electrically interconnected with said antenna element, wherein said cover and said antenna element cooperate to form a substantially flat structure, and wherein said connector extends away from the opposite second surface of said cover and external to said cover.

23. The antenna of claim 22 wherein said antenna element is a dipole antenna including a first linear member disposed between the first and second surfaces of said cover and a second linear member disposed between the first and second surfaces of said cover, said first and second linear members being at least substantially co-linear with respect to each other; and wherein said connector includes a first terminal electrically connected to said first linear member and a second terminal electrically connected to said second linear member.

24. The antenna of claim 22 wherein said antenna element is a loop antenna including a loop element disposed between the first and second surfaces of said cover, said loop element including a first end and a second end; and wherein said connector includes a first terminal electrically connected to the first end of said loop element and a second terminal electrically connected to the second end of said loop element.

25. The antenna of claim 22 wherein said antenna element is a patch antenna including a member disposed between the first and second surfaces of said cover.

26. The antenna of claim 22 wherein said substantially flat structure has a first thickness; wherein said antenna element has a second thickness; and wherein said first thickness is less than four times said second thickness.

27. The antenna of claim 22 wherein said substantially flat structure has a first thickness; wherein said antenna element has a second thickness; and wherein said first thickness is about two times said second thickness.

* * * * *